US005725311A

United States Patent [19]

Ponsi et al.

[11] Patent Number: 5,725,311

[45] Date of Patent: Mar. 10, 1998

[54] RESEALABLE PACKAGE WITH LABEL PEELING INHIBITING MEANS

[75] Inventors: Lawrence G. Ponsi, Wheeling; Steven W. Hickman, Woodstock, both of Ill.

[73] Assignee: Sage Products, Inc., Crystal Lake, Ill.

[21] Appl. No.: 684,127

[22] Filed: Jul. 19, 1996

[51] Int. Cl.[6] ..... B65D 33/16

[52] U.S. Cl. ..... 383/66; 206/494; 206/812; 229/123.1; 383/211

[58] Field of Search ..... 229/123.1; 220/258; 206/812, 449, 494; 383/66, 211

[56] References Cited

U.S. PATENT DOCUMENTS

| | | | |
|---|---|---|---|
| 4,417,658 | 11/1983 | Gardner et al. | 383/66 X |
| 4,550,831 | 11/1985 | Whitford | 383/66 X |
| 4,552,269 | 11/1985 | Chang | 383/211 |
| 4,679,693 | 7/1987 | Forman | 383/211 X |
| 4,709,399 | 11/1987 | Sanders | 383/66 |
| 4,723,301 | 2/1988 | Chang | 383/66 |
| 4,840,270 | 6/1989 | Caputo . | |

FOREIGN PATENT DOCUMENTS

| | | | |
|---|---|---|---|
| 0546369 | 6/1993 | European Pat. Off. | 383/66 |
| 2177677 | 1/1987 | United Kingdom | 383/66 |

*Primary Examiner*—Bryon P. Gehman

*Attorney, Agent, or Firm*—Lee, Mann, Smith, McWilliams, Sweeney & Ohlson

[57] ABSTRACT

A resealable package having a label applied over an opening into the package. The label has a pressure-sensitive adhesive, and is repeatably peelable from the package body and reappliable thereto. Full peeling of the label from the body is inhibited by a portion of the label co-acting with a portion of the package body. In one form of the invention, the label has cuts on opposite sides with an uncut portion therebetween, and the inhibiting of peeling is due to puckering of the package and the label when the label is peeled back to the cuts. In a second form of the invention, the package includes tabs or fragments which adhere to the label, with the peeling being inhibited when un-cut portions of the tabs or fragments are reached.

7 Claims, 1 Drawing Sheet

RESEALABLE PACKAGE WITH LABEL PEELING INHIBITING MEANS

BACKGROUND OF THE INVENTION

This invention relates to resealable packages, and in particular to a resealable package which has a label seal which can be peeled and reapplied repeatedly. The label seal is inibited from peeling past a predetermined location so that the label ordinarily is not removed from the resealable package.

The present invention is particularly usable for providing a package for impregnated cleansing cloths, although many other usages can be envisioned, as well. U.S. Pat. No. 4,840,270 is directed to a resealable package having a label flap applied to the package surface. A potion of the package surface is treated with a corona discharge so that the adhesive characteristics in the treated area are enhanced. As a result, the label sticks more firmly to that potion of the package, and when the label is peeled, the area of enhanced adhesion resists peeling of the label completely from the package.

While the package of U.S. Pat. No. 4,840,270 is an improvement which tends to prevent inadvertent removal of the label flap from the package, corona discharge treating of the package is an additional step in preparation of the package, and therefore an additional cost. In addition, the corona discharge must be controlled accurately, or variable surface characteristics will be obtained, and an enhanced adhesion may not, in actuality, occur. It is therefore advantageous to eliminate the additional step and uncertainty, while still providing a resealable package which has a label which resists removal after the label has been peeled to a predetermined location on the package body.

SUMMARY OF THE INVENTION

The invention relates to a resealable package which comprises a flexible package body having an internal space therein for housing contents of the package. The package body is provided with an elongated opening to the internal space for accessing the contents. A label having pressure-sensitive adhesive means on one side is applied to the package body on a generally uniform surface thereof. The label, when applied, conceals the elongated opening, and is formed to be repeatedly peeled from the uniform surface of the package body and reapplied thereto. Means is provided for inhibiting peeling of the label past a predetermined location. The inhibiting means comprises a portion of the label which co-acts with a portion of the package body to temporarily deform at least one of the portions to inhibit peeling past the predetermined location.

In accordance with the preferred form of the invention, the inhibiting means comprises opposite cuts in the label with an uncut portion of the label between the cuts. In one version of this form of the invention, the cuts are curved and extend from opposite side edges of the label. In a second version of this form of the invention, the cuts are straight and extend substantially perpendicular to opposite edges of the label. In this version, tear preventative ends are provided on the cuts. The tear preventative ends are preferably further circular cuts.

In accordance with another form of the invention, the opening comprises spaced slits in the package body which define an elongated fragment connected at one end to the package body. The inhibiting means comprises the fragment, which adheres to the label when the label is peeled from the package body. When the point of attachment of the fragment to the body is reached, peeling is inhibited.

In yet another form of the invention similar to that just described, the opening comprises an elongated slit. The inhibiting means comprises a tab in the package body at one end of the slit, with the tab adhering to the label when the label is peeled. When the point of attachment of the tab is reached, further peeling is inhibited.

In a further version of this form of the invention, a pair of tabs are formed in the package body at one end of the slit, with both tabs adhering to the label when peeled. The tabs can be contiguous or can be spaced. In either version, with the tabs adhering to the label, when the label is peeled from the package body, peeling is inhibited when the points of attachment of the tabs to the package body are reached.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

Figure 1:
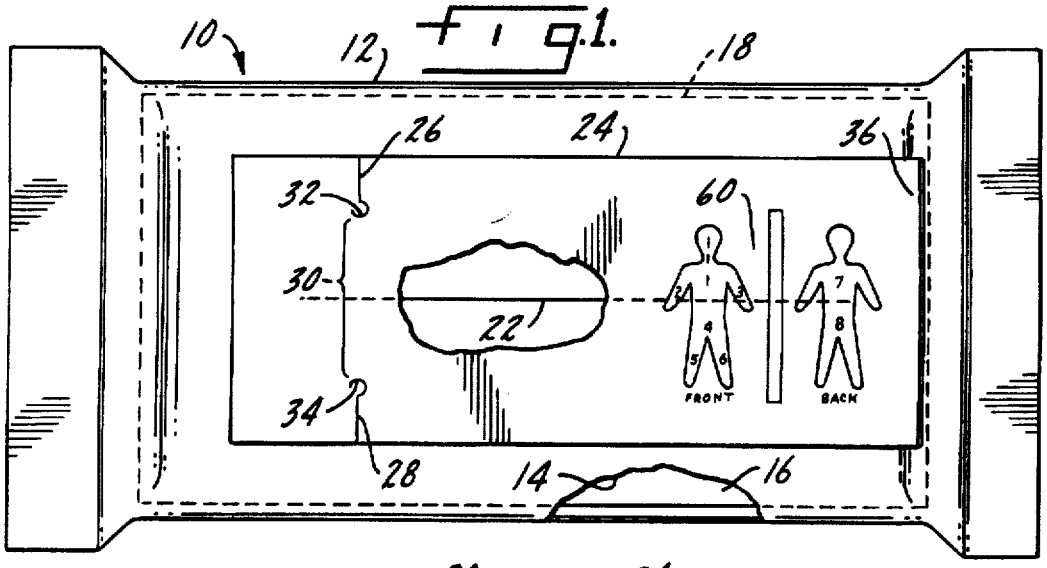
FIG. 1 is a top plan view of one form of a resealable package according to the invention, with portions cut away to illustrate detail.

A resealable package according to the invention is shown generally at 10 in the drawing figures. The package 10 includes a flexible package body 12 which has an internal space 14 therein for housing contents of the package 10. In the version illustrated in the drawing figures, the contents of the package comprise a series of individual cleansing cloths 16 which can be impregnated with appropriate cleansing solutions. The cloths 16 essentially fill the internal space 14 within the package body 12, as illustrated by the phantom outline 18 in FIG. 1 and the similar phantom outline 20 in FIG. 2.

The package 10 includes an elongated opening 22 through the package body 12 to the internal space 14 for accessing the contents of the package. In the form illustrated in FIG. 1, the opening 22 is an elongated slit. A label 24 is applied to the package body 12 for sealing and concealing the opening 22. The label 24 is applied to a generally uniform surface of the package body 12, and includes a pressure-sensitive adhesive on its side facing the package body 12 so that the label can be repeatedly peeled from the package body and reapplied thereto in order to gain access to the opening, and then reseal the package. Alternatively, the label 24 can be formed with adhesive characteristics rather than a separate layer of pressure-sensitive adhesive, or other means, so long as the label is repeatedly peelable from the package body. Generally the package body itself, which is preferably formed of plastic, will constitute a sufficiently uniform surface for application of the label without further surface preparation or treatment. If not, it is preferred that the surface area beneath the label be formed to be generally uniform so that peeling of the label from that surface normally requires a substantially constant force.

The label 24 is provided with means for inhibiting peeling of the label past a predetermined location. The inhibiting means comprises a portion of the label 24 which coacts with a portion of the package body 12 to temporarily deform at least one of the two portions to inhibit peeling past the predetermined location. In this form of the invention, the label is provided with opposite cuts 26 and 28 extending from opposite side edges of the label 24, with an uncut portion 30 of the label 24 being located between the cuts 26 and 28. The cuts 26 and 28 are straight and extend substantially perpendicular to the opposite side edges of the label 24. Each of the cuts includes a tear preventative end which is in the form of additional circular cuts 32 and 34 as illustrated. The circular cuts 32 and 34 tend to prevent tearing of the label 24 into the uncut portion 30 when the label 24 is peeled.

Figure 2:
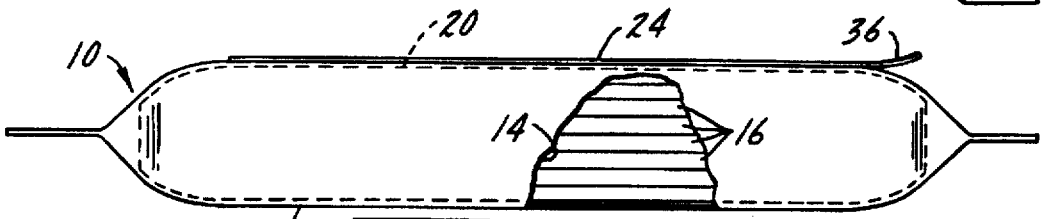
FIG. 2 is a side elevational view thereof, with a portion cut away to again illustrate detail.

As best shown in FIG. 2, the label 24 also includes a free end 36 which can be grasped by the user to facilitate peeling of the label 24 from the package body 12. The free end 36 is adhesive free or otherwise prepared so that it does not adhere to the package body 12 when the label 24 is applied.

When access to the contents of the package 10 is sought, the user begins peeling of the label 24 by grasping the free end 36, and then peeling from right to left (in relation to FIGS. 1 and 2). When the cuts 26 and 28 are reached, however, peeling is substantially inhibited because only the uncut portion 30 remains affixed to the package body 12 when the label 24 has been peeled to this point. Should the user try to peel the label 24 further, the package body 12 and the label 24 tend to gather or pucker at the uncut portion 30, substantially inhibiting further peeling of the label. While the user could, with substantial additional force, peel the label 24 completely from the package or perhaps tear the label to remove it, substantial force would be required, and therefore the location at which the cuts 26 and 28 are situated in the label 24 comprises a point at which peeling of the label 24 is substantially inhibited, signalling the user that the label has been sufficiently removed. The contents of the package body 12 can then be accessed through the opening 22 for use as desired.

Figure 6:
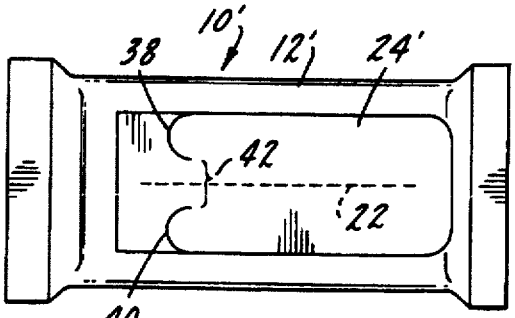
FIG. 6 is another view similar to FIG. 3, with yet a further form of resealable package according to the invention.

Turning next to FIG. 6, illustrated is a resealable package 10' which is essentially identical to the resealable package 10. Identical items bear the same reference numerals. In this form of the invention, however, a modified label 24' is employed, having a pair of curved cuts 38 and 40 which extend from opposite side edges of the label 24'. An uncut portion 42 extends between the curved cuts 38 and 40. As shown, the cuts 38 and 40 are curved in a concave manner in the direction that the label 24' is peeled. In exactly the same fashion as the first form of the invention, the cuts 38 and 40 provide a location at which peeling of the label 24' is inhibited since when peeling progresses to the cuts 38 and 40, the uncut portion 42 adheres to the package body 12', and if the user tries to further remove the label 24', the label and package body gather or pucker at the uncut portion 42, resisting further peeling in exactly the same fashion as the first form of the invention.

Figure 3:
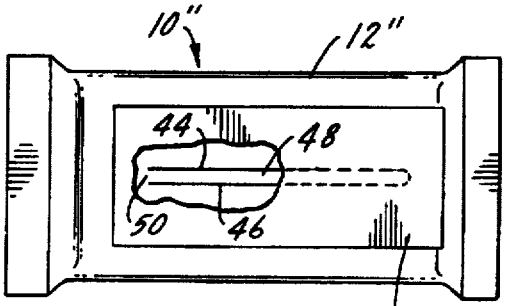
FIG. 3 is a reduced dimension top plan view similar to FIG. 1, but illustrating an alternative form of the invention, and with portions cut away to illustrate detail.

Turning now to FIG. 3, a modified resealable package 10" is composed of a package body 12" with a label 24" applied thereto in the same fashion as described in relation to the first form of the invention. In this form of the invention, however, the opening is formed by a pair of spaced slits 44 and 46 in the package body 12" which define an elongated fragment 48 which is connected at a distal end 50 to the package body 12". Otherwise, the fragment 48 is free to peel with the label 24" when it is peeled. When that occurs, when the distal end 50 is reached, and due to the fact that the fragment 48 adheres to the label 24", when the distal end 50 is reached, peeling is inhibited, and if the user tries to peel the label 24" further, the label 24" and the material of the package body 12" adjacent the distal end 50 tend to gather or pucker, substantially preventing further peeling of the label 24". This, again, is a point or location past which peeling of the label 24" is substantially inhibited.

Figure 4:
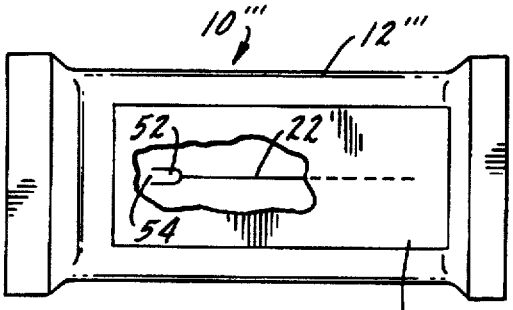
FIG. 4 is a view similar to FIG. 3 but of another form of the invention.

A further version of the invention is illustrated in FIG. 4. In this form of the invention, the resealable package 10'41 includes a single slit opening 22 through the package body 12'". The slit 22, however, is terminated by a tab 52 which has a distal end 54 connected to the material of the package body 12'". The tab 52 adheres to the underside of the label 24'" and, in exactly the same fashion as illustrated and described in relation to FIG. 3, when the label 24'" is peeled back to the location of the distal end 54, the adherence of the tab 52 to the underside of the label 24'" inhibits peeling beyond the distal end 54.

Figure 5:
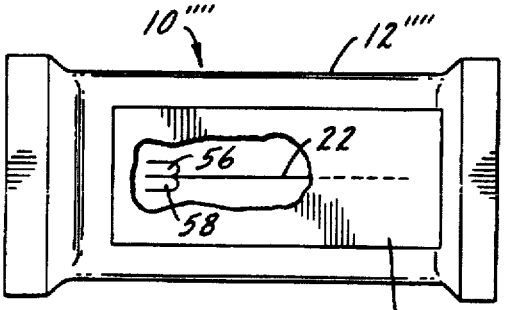
FIG. 5 is a view similar to FIG. 3, but of yet another form of the invention.

A final version of the invention is illustrated at 10"" in FIG. 5. This form of the invention varies only in that the tab 54 of FIG. 4 is replaced by a pair of contiguous tabs 56 and 58. The adherence of the tabs 56 and 58 to the underside of the label 24"" inhibits peeling of the label 24"" past the tabs 56 and 58.

As explained above, normally the package body 12 (and iterations thereof) is formed of a flexible plastic material, and it is preferred that the label 24 (and iterations thereof) is also formed of a suitable flexible plastic material. Other materials, however, can be employed so long as the features of the invention, as explained above, occur with the different materials. Formation of the package 10, including the opening 22, can be in any conventional fashion.

The label 24 is illustrated with a pictorial legend 60 which can illustrate use of each of the cloths 16 on various portions of the body. Obviously, whatever legends and information appear on the label 24 will depend on the nature of the contents of the package and their intended uses.

Various changes can be made to the invention without departing from the spirit thereof or scope of the following claims.

What is claimed is:

1. A resealable package, comprising a. a flexible package body having an internal space therein for housing contents, b. an elongated opening through the package body to said internal space for accessing the contents, c. a label having pressure-sensitive adhesive on one side of the label, said label being applied to said package body on a generally uniform surface thereof to conceal said opening, and said label being formed to be repeatedly peeled from said uniform surface of said package body and reapplied thereto, and d. means for inhibiting peeling of said label past a predetermined location, said inhibiting means comprising a portion of said label coacting with a portion of said package body to temporarily deform at least one of said portions to inhibit peeling past said location, said inhibiting means comprising opposite cuts in said label and an uncut portion of said label between said cuts, said cuts being curved in a concave manner in the direction from which said label is peeled and extending from opposite side edges of said label.

2. A resealable package according to claim 1 including tear preventative ends of said cuts.

3. A resealable package according to claim 2 in which said tear preventative ends comprise circular cuts.

4. A resealable package according to claim 1 in which said opening comprises an elongated slit.

5. A resealable package according to claim 1 in which said label includes a free end to facilitate peeling of said label.

6. A resealable package, comprising a. a flexible package body having an internal space therein for housing contents, b. an elongated opening through the package body to said internal space for accessing the contents, said opening comprising an elongated slit, c. a label having a pressure-sensitive adhesive on one side of the label, said label being applied to said package body on a generally uniform surface thereof to conceal said opening, and said label being formed to be repeatedly peeled from said uniform surface of said package body and reapplied thereto, and d. means for inhibiting peeling of said label past a predetermined location, said inhibiting means comprising a portion of said label coacting with a portion of said package body to temporarily deform at least one of said portions to inhibit peeling past said location, said portion of said package body comprising a pair of contiguous tabs in said package body at one end of said slit and adhering to said label.

7. A resealable package according to claim 6 in which said label includes a free end to facilitate peeling of said label.

* * * * *